United States Patent [19]

Suzuki et al.

[11] 4,398,983

[45] Aug. 16, 1983

[54] BINDING METHOD USING ADHESIVE TAPE

[75] Inventors: Tomosaburo Suzuki, Tsukui; Akira Wakahara, Hino, both of Japan

[73] Assignee: Kabushiki Kaisha Daisei Kikai, Tokyo, Japan

[21] Appl. No.: 279,579

[22] Filed: Jul. 1, 1981

[30] Foreign Application Priority Data

Jul. 1, 1980 [JP] Japan ..... 55-89852

[51] Int. Cl.[3] ..... B65B 13/02; B65H 81/00

[52] U.S. Cl. ..... 156/185; 156/186; 156/192; 156/227; 156/269; 156/302; 156/289; 53/399; 53/412; 428/77; 428/192; 428/194

[58] Field of Search ..... 156/185, 289, 192, 227, 156/269, 302; 150/43; 229/62; 24/30.5 R, 30.5 P, 16 R; 292/253; 428/77, 343, 354, 41, 40, 906, 192, 194; 53/399, 412, 582, 592, 186

[56] References Cited

FOREIGN PATENT DOCUMENTS 1516138 6/1978 United Kingdom ..... 229/62

OTHER PUBLICATIONS

*Primary Examiner*—Alexander S. Thomas

*Attorney, Agent, or Firm*—Oblon, Fisher, Spivak, McClelland & Maier

[57] ABSTRACT

An adhesive tape useful for winding around an article to be bound is provided with at least one non-adhesive end part by adhering a second tape piece to such end part, whereby ready separation and unbinding of the bound article is facilitated. A method for producing the adhesive tape includes the cutting of pieces of the second tape and securing such pieces at predetermined intervals of the adhesive tape and cutting of the adhesive tape in predetermined lengths.

5 Claims, 12 Drawing Figures

BINDING METHOD USING ADHESIVE TAPE

BACKGROUND OF THE INVENTION

An adhesive tape has often been used in order to sack, pack or bind various kinds of goods. As examples, an adhesive tape is applied to the puckered opening of a bag into which goods are put, and the adhesive faces on the ends of the tape are then closed against each other, as shown in FIG. 1, or such an adhesive tape is simply spirally wound around the opening of a bag, as shown in FIG. 2.

In such conventional manners, however, it is often difficult to peel the adhesive face of the adhesive tape from a bag, without breaking the bag, because the adhesive face is secured thereto.

Also, previously, a binding method using adhesive tape has been adopted, in which an adhesive tape piece is provided with an end part made as a non-adhesive face, by folding back the end part, so that the adhesive face is left as an inner side and is wound around, thereby to facilitate unpacking and repacking (Published unexamined parent application (Kōkai Tokkyo Kōhō), No. 98897/1979). This binding method is very useful for consumers, but it requires an operation of folding back the adhesive end part of a binding tape piece when binding. Disadvantageously, it is difficult to effect binding by a simple mechanism and it is not always easy to mechanize this method.

SUMMARY OF THE INVENTION

The present invention, therefore relates to a binding method using an adhesive tape, in which an adhesive tape piece is wound around an article to be bound, in such a state that its end part is made as a non-adhesive face, and particularly provides such a binding method which is easy in mechanization.

According to the present invention, there is provided a binding method in which binding can be effected by a relatively east mechanism, without requiring the folding-back of the end part of an adhesive tape piece.

BRIEF DESCRIPTION OF THE DRAWINGS

Various other objects, features and attendant advantages of the present invention will become apparent from the following detailed description when considered in connection with the accompanying drawings, in which like reference numerals designate like or corresponding parts throughout the several views, and wherein.

DETAILED DESCRIPTION OF THE PREFERRED EMBODIMENTS

Figure 1:
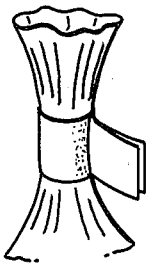
FIGS. 1 and 2 are perspective views of adhesive tape applications according to prior art inventions.
Figure 2:
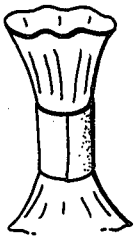
Figure 3:
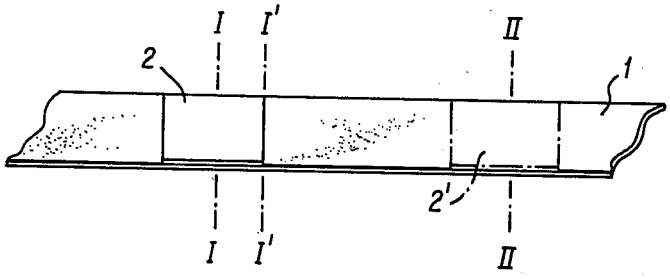
FIG. 3 is a perspective view showing an adhesive tape for explaining the binding method according to the present invention.

In the accompanying drawings, FIG. 3 shows an adhesive tape 1 used in the binding method according to the present invention. Another tape piece 2 such as another adhesive tape or paper tape is, as shown, stuck in layers or overlapping relation onto the adhesive tape 1, and the overlapping part is cut at its center along the line I—I.

Figure 4:
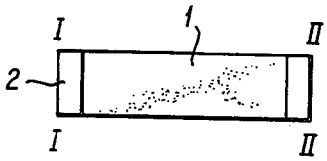
FIG. 4 is a plan view showing an example of an adhesive tape piece used in the binding method according to the present invention.

Then a further tape piece 2' is similarly stuck onto the adhesive tape at a position corresponding to the end of a tape piece having a length required for binding, and the overlapping part is also cut at its center along the line II—II, thereby to form an adhesive tape piece for binding, in which both the end parts thereof are made as a non-adhesive face by sticking the second tape pieces 2, 2' onto their adhesive faces, as shown in FIG. 4.

Figure 5:
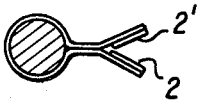
FIG. 5 is a transverse sectional view illustrating a binding practiced by the adhesive tape piece shown in FIG. 4.

By use of the thus formed adhesive tape piece, binding can be effected in such state that the end parts are not adhered to each other, as shown in FIG. 5, whereby unpacking and repacking can be easily effected.

Since the adhesive tape piece used for binding is formed by sticking another tape piece thereto so as to make its end parts with non-adhesive faces, furthermore, a mechanical treatment for forming the adhesive tape piece is facilitated, resulting in easy mechanization, as compared with a method folding back an adhesive tape over itself as in a conventional manner.

Figure 6:
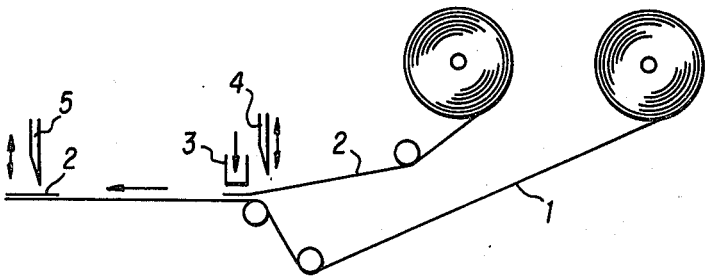
FIG. 6 is a side view showing the binding method according to the present invention.

When binding, namely, as shown in FIG. 6, an adhesive tape 1 taken from a roll is pressed by a pressor piece 3, thus putting another tape 2 on the adhesive face of the adhesive tape 1, whereby the second tape 2 is adhered on the adhesive face of the adhesive tape 1. In the binding according to the present invention, accordingly, it is sufficient to mechanically effect the three steps, namely to draw-out an adhesive tape 1 in a predetermined length, cut-off of the other tape 2 in a given length with a cutter 4 as it is transposed over the adhesive tape 1 and secured thereto, thus forming an outer non-adhesive face, and cut-off of the adhesive tape 1 and tape 2 secured thereto at the position I—I. Thus, it is facilitated to mechanically effect formation of an adhesive tape piece with non-adhesive end faces.

Figure 7:
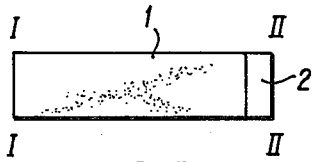
FIG. 7 is a plan view showing an example of another adhesive tape piece to be used in the binding method according to the present invention.
Figure 8:
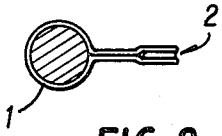
FIG. 8 is a transverse sectional view illustrating a binding practiced by the adhesive tape piece shown in FIG. 7.
Figure 9:
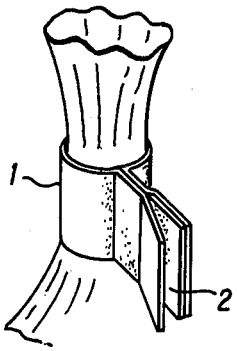
FIG. 9 is a perspective view of the bound part shown in FIG. 8.

In the binding case shown in FIGS. 3, 4 and 5, binding is effected in such a state that both the end parts of the adhesive tape piece used for binding are made as non-adhesive faces, by sticking further tape pieces 2, 2' thereto. However, binding may be effected, as shown in FIG. 8 and FIG. 9, by use of an adhesive tape piece in which the cutting position for the tape 1 shown in FIG. 3 shall be the line I'—I', and only one end part thereof shall be made as a non-adhesive face, as shown in FIG. 7.

In this case, the second tape piece 2 is one having its top face of a property hard to stick onto the adhesive tape, which thus produces the same effect, because both the end parts thereof are not adhered when they are put together.

Figure 10:
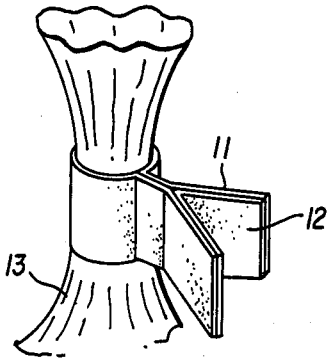
FIGS. 10 and 11 are perspective views showing the bound part obtained in another embodiment of the binding method according to the present invention, respectively.

In the embodiment shown in FIG. 10, binding is effected by use of an adhesive tape piece 11, in which the end parts of the adhesive tape piece 11 are made of non-adhesive faces, by sticking another tape piece 12 over both its adhesive end faces.

According to this embodiment, for example, it is sufficient to stick the second tape 12 onto both the adhesive end faces of the adhesive tape 11, after winding it around an article 13 to be bound. Therefore, handling is simple and mechanization is easy.

Since the second tape 12, continous between the end parts of the binding tape, is stuck thereto in this embodiment, furthermore, the tape 12 serves to seal the article to be bound. Thus, removal of a content from the package bag freely after binding is prevented.

By printing characters and letters for advertisement on the tape 12, the end parts of the binding tape can be effectively utilized for advertisement.

Figure 11:
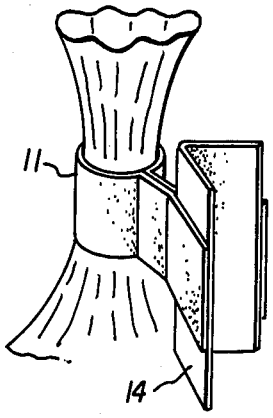

The embodiment shown in FIG. 11, in which a relatively large adhesion-preventing piece 14 twice-folded is made to adhesively intervene between the end parts of a binding tape 11, is equal in operation and effect to one shown in FIG. 10. In this case, the said adhesion-preventing piece 14 is devised to be more attractive and utilizable for advertisement.

In both the embodiments shown in FIG. 10 and FIG. 11, in addition, there may be adapted, as the tape piece 12 or the adhesion-preventing piece 14, tape pieces properly processed, for example, one easy to cut for unpacking at its gorge part, when both the end parts of the adhesive tape piece 11 left after binding are opened, or one having a cut line so as to be easily cut at its gorge part.

Figure 12:
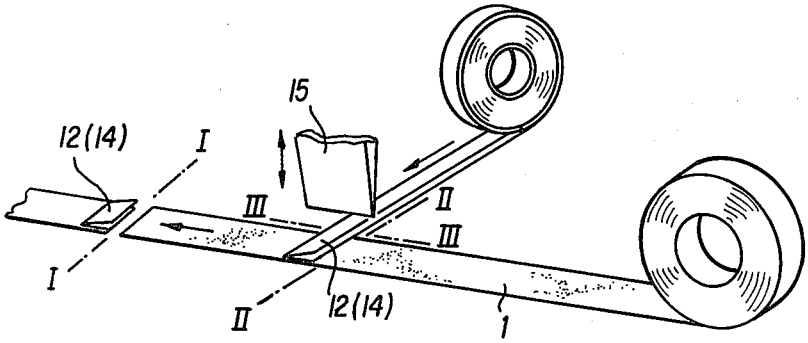
FIG. 12 is a perspective view illustrating the manufacture of an adhesive tape piece to be used in the bindings shown in FIG. 10 and FIG. 11.

FIG. 12 shows an outline of an embodiment for mechanically making an adhesive tape piece usable in the binding shown in FIG. 10 and FIG. 11, wherein an adhesive tape 11 of the feed material is drawn out in a given length, while another tape or adhesion-preventing material twice-folded is drawn from the side out on the adhesive tape 11, stuck at given intervals onto the adhesive tape 11, and then cut along the line III—III by a cutter 15.

Thus, a desired adhesive tape piece can be obtained by cutting the adhesive tape 11 with the second tape piece 12 or adhesion-preventing piece 14 stuck thereon along the line I—I and line II—II. Also in this case, it is possible to effect relatively easily and continuously formation of an adhesive tape piece usable in binding.

In the binding method using an adhesive tape according to the present invention, as concretely described above, an adhesive tape piece is wound around an article to be bound, in the state that its end parts are made as non-adhesive faces by another tape piece stuck on their adhesive end faces. It is, therefore, sufficient that another tape piece is merely stuck to the portions of an adhesive tape piece to be used for binding, which correspond to its end parts. Since it is possible to effect binding easily, mechanization of the binding is easy.

Another tape piece of this case may be replaced with one continued between both the ends of an adhesive tape as shown in FIG. 10, and it can be utilized as a sealing for the bound article.

According to another embodiment of the present invention, furthermore, an adhesion-preventing piece twice-folded may be made to intervene between both the end parts of an adhesive tape piece wound around an article to be bound, and the adhesion-preventing piece can be utilized for advertisement and the sticking operation of the adhesion-preventing piece is easy because it is large, and mechanization of the binding operation is facilitated.

As the second tape piece to be stuck on the end parts of the adhesive tape, in addition, there may be freely selected one which is colored or one which is printed. Such tapes can be advantageously utilized to provide information, for example, the date of packing or the grade of an article to be bound.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A binding method using an adhesive tape, said method comprising:

forming a first tape having at least one adhesive surface;

positioning individual pieces of second tape on an adhesive surface of said first tape at predetermined intervals;

cutting said first tape at said predetermined intervals to form tape segments having pieces of said second tape on at least one end; and winding one said tape segment about an article to be bound so that the ends of said tape segment face one another, whereby said second tape prevents adhesion of said ends of said tape segment.

2. The method of claim 1 wherein said pieces of second tape are folded about a line transverse to the longitudinal axis of said first tape so as to define two leaves, one of said leaves contacting one end of said first tape, and wherein said winding step includes contacting a second end of said first tape with a second one of said leaves.

3. The method of claim 1 wherein said pieces of second tape each extend in a single plane.

4. The method of claim 3 wherein said first tape is cut at positions corresponding to one axial end of said second tape pieces, whereby said tape segments have said pieces of second tape at only one end.

5. The method of claim 3 wherein said first tape is cut at positions corresponding to an axially central portion of said second tape pieces, whereby said tape segments have said pieces of second tape at both ends thereof.

* * * * *